United States Patent [19]

Walkiewicz

[11] 4,174,966

[45] Nov. 20, 1979

[54] HIGH COERCIVE FORCE RARE EARTH METAL-COBALT MAGNETS CONTAINING COPPER AND MAGNESIUM

[75] Inventor: John W. Walkiewicz, Reno, Nev.

[73] Assignee: The United States of America as represented by the Secretary of the Interior, Washington, D.C.

[21] Appl. No.: 969,767

[22] Filed: Dec. 15, 1978

[51] Int. Cl.[2] ..... C22C 19/00

[52] U.S. Cl. ..... 75/170; 75/152; 252/62.55

[58] Field of Search ..... 75/134 F, 152, 170, 75/200; 148/31.57; 252/62.55

[56] References Cited

U.S. PATENT DOCUMENTS

| | | | |
|---|---|---|---|
| 3,421,889 | 1/1969 | Ostertag et al. | 75/152 |
| 3,523,836 | 8/1970 | Buschow et al. | 75/152 |
| 3,560,200 | 2/1971 | Nesbitt et al. | 75/170 |
| 3,826,696 | 7/1974 | Cech | 148/31.57 |
| 3,839,102 | 10/1974 | Tawara et al. | 148/31.57 |
| 3,887,395 | 6/1975 | Martin | 148/31.57 |
| 3,892,601 | 7/1975 | Smeggil et al. | 148/31.57 |
| 3,947,295 | 3/1976 | Tawara et al. | 75/152 |
| 3,982,971 | 9/1976 | Yamanaka et al. | 75/152 |
| 3,998,669 | 12/1976 | Strnat | 148/31.57 |
| 4,047,982 | 9/1977 | Sagawa et al. | 75/152 |
| 4,082,582 | 4/1978 | Menth et al. | 75/152 |
| 4,099,995 | 7/1978 | Menth et al. | 75/152 |

OTHER PUBLICATIONS

Tawara et al., IEEE Trans. Magnetics, V. May -8, 1972, pp. 560(61).

Ratnam and Wella, *Proc. Conf. AIP,* Magnetism and Magnetic Materials, 18(2), 1973, pp. 1154(58).

Benz and Martin, Cobalt-Mischmetal-Samarium Permanent Magnet Alloys: Process and Properties, *J. Appl. Phys.,* 42, 1971, 2786(89).

Nesbitt et al., *J. Appl. Phys.,* 40, 1969, pp. 4006(09).

Tawara et al., *J. Appl. Phys.,* 7, 1968, p. 966.

*Primary Examiner*—L. Dewayne Rutledge
*Assistant Examiner*—John P. Sheehan
*Attorney, Agent, or Firm*—William S. Brown; Donald A. Gardiner

[57] ABSTRACT

A magnetic alloy composition, which comprises: an alloy of the formula:

34 to 37 wt.% RE 55.6 to 63.9 wt.% Co 2 to 7 wt.% Cu .05 to .40 wt.% Mg wherein RE is mischmetal or a rare earth metal excluding samarium.

8 Claims, No Drawings

HIGH COERCIVE FORCE RARE EARTH METAL-COBALT MAGNETS CONTAINING COPPER AND MAGNESIUM

ORIGIN OF THE INVENTION

The invention described herein was made by Employees of the United States Government and may be manufactured and used by or for the Government of the United States of America for Government purposes without the payment of any royalties thereon or therefor.

BACKGROUND OF THE INVENTION

1. Field of the Invention

The present invention relates to rare earth-cobalt permanent magnets. More particularly, the present invention relates to rare earth-cobalt magnets which do not contain samarium as an essential component.

2. Description of the Prior Art

Many permanent magnetic compositions are known which are based on a mixture of at least one rare earth metal and cobalt. However, of all of the type of rare earth-cobalt magnetic compositions, those which contain samarium optionally with or without the presence of another rare earth metal, are the most useful commercially. The principal drawback to samarium containing compositions is the high cost of producing samarium metal. However, the state-of-the art is such that only rare earth-cobalt magnets which contain samarium have had sufficient coercive force to enable the use of the magnets as high strength permanent magnets. The following prior art references show rare earth-cobalt magnet compositions many of which are samarium containing compositions:

Ostertag et al U.S. Pat. No. 3,421,889, Nesbitt et al U.S. Pat. No. 3,560,200, Cech U.S. Pat. No. 3,826,696, Martin U.S. Pat. No. 3,887,395, Smeggil et al U.S. Pat. No. 3,892,601, Strnat U.S. Pat. No. 3,998,669, and Sagawa et al U.S. Pat. No. 4,047,982, Buschow et al U.S. Pat. No. 3,523,836 show a rare earth-cobalt based composition in which the rare earth component is a combination of lanthanum and cerium, while Tawara et al U.S. Pat. No. 3,839,102 show a composition based upon a combination of cerium with cobalt and copper. The Tawara et al reference U.S. Pat. No. 3,947,295, Menth et al U.S. Pat. No. 4,082,582 and Yamanaka et al U.S. Pat. No. 3,982,971 all show multi-component magnetic compositions which contain at least samarium, copper, cobalt and iron.

Ratnam and Wells, *Proc. Conf. AIP*, Magnetism and Magnetic Materials, 18(2), 1973 pp. 1154(58), have shown a magnetic composition in which from 6 to 9 wt.% samarium was added to mischmetal-cobalt alloys while Benz and Martin, Cobalt-Mischmetal-Samarium Permanent Magnet Alloys: Process and Properties, *J. Appl. Phys.*, 42, 1971, 2786(89) have reported mischmetal-cobalt-samarium magnetic compositions which contain up to 18 wt.% samarium. Still other reports show alloy compositions in which iron and copper have been added to various rare earth-cobalt alloys prepared by casting techniques. (Nesbitt et al, *J. Appl. Phys.*, 40, 1969, pp 4006(09) and Tawara et al, *J. Appl. Phys.*, 7, 1968, p 966). However, the properties of these as-cast, copper containing magnets are not as sufficient as desired, and sintered $SmCO_5$ has found favor instead. Still another type of sintered magnetic material which has been investigated is a cerium-cobalt-copper-iron alloy as described by Tawara et al, IEEE Tans. Magnetics, v. MAG-8, 1972, pp 560(61). However, the process for producing the magnetic alloy requires a post-sintering aging treatment at a temperature between 300° and 400° C. for minimum of three hours in order to increase the intrinsic coercivity to a maximum value of 7,000 oersteds. However, the magnetic alloy of the present invention possesses a substantially higher intrinsic coercivity of about 28,000 oersteds, which is equaled only by Sm-Co magnets, than the alloy above. Moreover, the high intrinsic coercivity properties are induced in the present alloy by a significantly simpler procedure which does not require an aging cycle.

Therefore, a need continues to exist for a magnetic alloy whose magnetic properties are at least as good as samarium based alloys but yet which is not based upon samarium.

SUMMARY OF THE INVENTION

Accordingly, one object of the present invention is to provide a magnetic alloy composition which does not contain samarium but yet which has magnetic properties which are at least as good as samarium based magnetic alloys.

Another object of the present invention is to provide a magnetic alloy of excellent magnetic characteristics.

Briefly, these objects and other objects of the present invention as hereinafter will become more readily apparent can be attained by a permanent magnetic composition comprising an alloy of the formula:

34 to 37 wt.%RE 2.0 to 7.0 wt.% Cu 0.05 to 0.40 wt.% Mg 55.6 to 63.9 wt. Co wherein RE is mischmetal or a rare earth element excluding samarium.

DESCRIPTION OF THE PREFERRED EMBODIMENTS

Prior to the discovery of the magnetic alloy of the present invention, it was found that the addition of copper to Pr-Co and MM-Co alloys (MM hereinafter is defined as mischmetal which is a cerium rich metal mixture of rare earth elements.) results in an improvement in intrinsic and normal coercive force characteristics of the magnetic materials over the non-copper containing alloys. This discovery has led to the present invention in which it has been found that the further addition of magnesium to a rare earth metal (samarium excluded)-cobalt-copper alloy results in a magnetic alloy whose intrinsic coercivity characteristics are at least as good as Sm-Co based magnetic alloys. The magnetic alloy of the present invention can be described by the formula:

34 to 37 wt.% RE 55.6 to 63.9 wt.% Co 2 to 7 wt.% Cu 0.05 to 0.40 wt.% Mg.

The rare earth component of the alloy includes such metals as praeseodymium, cerium, lanthanum as well as cerium containing mischmetal but excludes samarium. A preferred magnetic alloy composition is one in which mischmetal is employed as the rare earth metal component and is of the formula:

35 to 36 wt.% MM 4 to 7 wt.% Cu 0.05 to 0.30 wt.% Mg with the remainder cobalt. Yet a more preferred alloy composition has the formula:

35.5 wt.% MM 4.5 to 6.0 wt.% Cu 0.05 to 0.30 wt.% Mg with the remainder cobalt.

The alloy of the present invention can be prepared by any known technique which is acceptable for the preparation of rare earth metal-cobalt magnetic alloys. Accordingly, one such satisfactory method involves initially forming a rare earth metal-cobalt alloy of the desired stoichiometry by arc melting cobalt and rare earth metal alloy in the desired amount under an inert gas or oxygen free atmosphere. Suitable inert gases include nitrogen, carbon dioxide, the inert gases and the like. A non-consumable electrode should be employed in the arc melting process. Another satisfactory method of forming the alloy of the present invention is to melt a rare earth metal-cobalt alloy in an induction furnace. After the alloy is obtained it is crushed or pulverized in a device such as a jet mill, ball mill or the like to a fine powder material. To the rare earth metal-cobalt alloy of the desired composition is then added copper- and magnesium-containing alloys in the desired amounts to form the basic four component alloy of the present invention. Mischmetal-cobalt alloys which have been found to be suitable materials for admixture with copper and magnesium include alloys of the following types:

$MM(Co,Cu)_5$, $MM(Co,Mg)_5$, $MM(Co,Cu,Mg)_5$, $MM_2(Co,Cu)_7$, $MM_2(Co,Mg)_7$ and $MM_2(Co,Cu,Mg)_7$.

After the alloy mixture is crushed into a fine powder, the particles are aligned and compacted in a magnetic field. Any pressure can be employed which yields a suitably compacted material. Generally, pressures of at least about 50,000 psi are employed. The aligned compacted material is then sintered at a temperature range of 980° to 1,000° C. under an inert atmosphere such as a helium atmosphere. After sintering the compact is cooled. Normally, the compact is cooled at a fairly rapid rate on the order of 1,000° C. down to 400° C. in a time span of about 20 to 30 minutes. This amounts to a rate of about 20°–30° C. per minute.

In a preferred embodiment of forming a desired alloy preparatory to alignment and compaction in a magnetic field, the desired quantities of cobalt-rare earth alloy and cobalt-copper-rare earth alloy are melted, inverted and remelted with the cycle being repeated several times to achieve homogeneity. The homogeneous alloy is then broken into small pieces, which are intermixed and reweighed into a new charge. The charge is melted twice more to ensure homogeneity. Since the magnesium component of the present alloy vaporizes at a lower temperature than copper, cobalt or rare earth metal, magnesium is not added initially to the alloy mixture but rather is added to the alloy after several melting steps have been taken to reduce loses of magnesium by vaporization. Another way of reducing loses is to melt the alloy mixtures containing magnesium from the start under pressure of an inert atmosphere.

Having generally described the invention, a further understanding can be attained by reference to certain specific examples which are provided herein for purposes of illustration only and are not intended to be limiting unless otherwise specified.

EXAMPLES 1–28

The various magentic alloy compositions shown in the Table below were obtained by blending copper and magnesium with misch metal-cobalt alloy. In order to prepare a specific alloy product one or more alloys in Table I below were selected and charged to a melting device in the amounts necessary to achieve an alloy of a given composition. The charge to the melting device normally ranged from 60 to 100 grams. The charge was melted, inverted, and remelted a total of five times to achieve homogeneity. Since many charges were prepared as evidenced by the many compositions in Table II below, all charges were removed from the furnace and broken into small sized pieces, intermixed, reweighed into new charges of 70–75 grams and melted twice more to ascertain complete homogeneity of the alloy mass. This procedure was followed for all alloys except those which contained magnesium. Because magnesium vaporizes more readily than the rare earth metal, cobalt and copper components, magnesium was added in the desired amount after the first five meltings to minimize loss by vaporization.

TABLE I

| Alloy | MM | Cu | Mg |
|---|---|---|---|
| 1 | 33.5 | 0.0 | 0.0 |
| 2 | 33.5 | 14 | 0 |
| 3 | 33.5 | 14 | .49 |
| 4 | 33.5 | 14 | .62 |
| 5 | 40.7 | 0 | .34 |
| 6 | 40.7 | 21 | 0 |
| 7 | 40.7 | 21 | .51 |

Remainder = cobalt.

Each alloy mass obtained was crushed to a mesh size of −35 with a mechanical mortar and pestle (Fritsch Pulverisette) and ground to an average particle size of 2 to 3 micrometers using a Spex Industries shatterbox. Each powder obtained was compacted at a pressure of about 50,000 psi and simultaneously aligned in a magnetic field of 8,000 gauss. Each alloy mass was then sintered at a temperature between 980° and 1,000° C. for two hours and then quenched in air. That is, the samples were removed from the furnace at sintering temperature and allowed to cool at ambient temperature. The properties of each alloy prepared are shown in the following Table.

TABLE II

Effects of copper and magnesium on the magnetic properties of various MM—Co alloys

| Examples. | Cu content, wt-pct | Mg content, wt-pct | Sintered density, g/cm$^3$ | Intrinsic coercivity, kOe | Normal coercivity, Oe | Remanence, G | Energy product, MGOe |
|---|---|---|---|---|---|---|---|
| | 35.0 wt-pct MM, remainer Co: | | | | | | |
| 1 | 0.0 | 0.09 | 7.20 | 3.7 | 3,330 | 5,440 | 5.5 |
| 2 | .0 | .09 | 7.21 | 3.6 | 3,290 | 5,480 | 5.7 |
| 3 | 5.0 | .0 | 6.70 | 1.2 | 1,140 | 4,500 | 2.6 |
| 4 | 5.5 | .0 | 8.11 | .6 | 500 | 6,190 | 1.8 |
| 5 | 4.4 | .08 | 8.15 | 7.6 | 4,450 | 5,840 | 7.8 |
| 6 | 5.0 | .07 | 8.23 | 13.2 | 6,020 | 6,550 | 10.0 |
| 7 | 5.6 | .08 | 8.18 | 25.3 | 5,760 | 6,030 | 8.8 |
| | 35.5 wt-pct MM, remainder Co: | | | | | | |

TABLE II-continued

| Examples. | Cu content, wt-pct | Mg content, wt-pct | Sintered density, g/cm³ | Intrinsic coercivity, kOe | Normal coercivity, Oe | Remanence, G | Energy product, MGOe |
|---|---|---|---|---|---|---|---|
| | | Effects of copper and magnesium on the magnetic properties of various MM—Co alloys | | | | | |
| 8 | .0 | .11 | 7.51 | 4.0 | 3,600 | 5,820 | 6.7 |
| 9 | .0 | .11 | 7.89 | 3.5 | 3,260 | 6,470 | 9.0 |
| 10 | 4.0 | .0 | 7.98 | 2.2 | 2,040 | 6,160 | 6.5 |
| 11 | 5.0 | .0 | 7.97 | 2.0 | 1,920 | 5.980 | 5.7 |
| 12 | 3.9 | .10 | 8.22 | 5.1 | 4,680 | 6,230 | 8.8 |
| 13 | 4.4 | .10 | 8.22 | 17.0 | 6,050 | 6,280 | 9.5 |
| 14 | 4.5 | .21 | 8.22 | 15.8 | 5,950 | 6,370 | 9.5 |
| 15 | 4.9 | .10 | 8.21 | 23.2 | 5,870 | 6,110 | 9.0 |
| 16 | 5.0 | .18 | 8.14 | 28.6 | 5,500 | 5,800 | 8.0 |
| 17 | 5.5 | .09 | 8.22 | 22.4 | 5,400 | 5,980 | 8.1 |
| 18 | 5.6 | .10 | 8.19 | 27.8 | 5,610 | 5,840 | 8.2 |
| 19 | 5.9 | .10 | 8.16 | 23.5 | 5,540 | 5,750 | 8.0 |
| 20 | 6.0 | .09 | 8.16 | 26.8 | 5,500 | 5,840 | 7.8 |
| | 36.0 wt-pct MM, remainder Co: | | | | | | |
| 21 | .0 | .13 | 7.66 | 4.3 | 3,980 | 5,980 | 8.2 |
| 22 | .0 | .13 | 7.86 | 3.8 | 3,410 | 5,690 | 7.2 |
| 23 | 4.0 | .0 | 8.22 | .7 | 670 | 6,240 | 2.0 |
| 24 | 5.0 | .0 | 8.23 | .7 | 630 | 6,060 | 1.8 |
| 25 | 4.5 | .18 | 8.19 | 19.1 | 5,370 | 5,720 | 7.7 |
| 26 | 5.0 | .18 | 8.12 | 27.6 | 5,500 | 5,790 | 8.0 |
| 27 | 5.5 | .19 | 8.18 | 27.1 | 5,421 | 5,850 | 7.9 |
| 28 | 6.0 | .21 | 8.18 | 27.6 | 6,050 | 6,260 | 9.5 |

The results above show that a number of alloy compositions exhibit very high intrinsic coercivities which are comparable to typical intrinsic coercivities obtained for samarium-cobalt magnetic alloys. For those alloys which lack either copper or magnesium as a component, the intrinsic coercivity values are substantially inferior to those alloys which contain both magnesium and copper.

Having now fully described the invention it will be apparent to one of ordinary skill in the art that many changes and modifications can be made thereto without departing from the spirit or scope of the invention as set forth herein.

Accordingly, what is claimed as new and is intented to be secured by letters patent is:

1. A magnetic alloy composition, which comprises: an alloy of the formula:

34 to 37 wt.% RE 55.6 to 63.9 wt.% Co 2 to 7 wt.% Cu 0.05 to 0.40 wt.% Mg wherein RE is mischmetal or a rare earth metal excluding samarium.

2. The alloy of claim 1, wherein said alloy is of the formula: 35 to 36 wt.% MM 4 to 7 wt.% Cu 0.05 to 0.30 wt.% Mg with the remainder cobalt.

3. The alloy of claim 2, wherein said alloy is of the formula: 35.5 wt.% MM 4.5 to 6.0 wt.% Cu 0.05 to 0.30 wt.% Mg with the remainder cobalt.

4. The alloy of claim 3, wherein said alloy is: 35.5 wt.% MM 5.0 wt.% Cu 0.18 wt.% Mg 59.32 wt.% Co.

5. The alloy of claim 3, wherein said alloy is: 35.5 wt.% MM 5.6 wt.% Cu 0.1 wt.% Mg 58.8 wt.% Co.

6. The alloy of claim 3, wherein said alloy is: 36.0 wt.% MM 5.0 wt.% Cu 0.18 wt.% Mg 58.82 Wt.% Co.

7. The alloy of claim 3, wherein said alloy is: 36.0 wt.% MM 6.0 wt.% Cu 0.21 wt.% Mg 57.79 wt.% Co.

8. The alloy of claim 1, wherein said rare earth element is praeseodymium, cerium or lanthanum.

* * * * *